US005793289A

United States Patent [19]

Strzelec

[11] Patent Number: 5,793,289

[45] Date of Patent: Aug. 11, 1998

[54] PULSED INTERROGATION SIGNAL IN HARMONIC EAS SYSTEM

[75] Inventor: Stanley A. Strzelec, Boca Raton, Fla.

[73] Assignee: Sensormatic Electronics Corporation, Deerfield Beach, Fla.

[21] Appl. No.: 879,118

[22] Filed: Apr. 18, 1997

Related U.S. Application Data

[63] Continuation of Ser. No. 625,647, Mar. 29, 1996, abandoned.

[51] Int. Cl.[6] ..... G08B 13/187

[52] U.S. Cl. ..... 340/572; 340/551

[58] Field of Search ..... 340/572, 551

[56] References Cited

U.S. PATENT DOCUMENTS

| | | | |
|---|---|---|---|
| 3,713,102 | 1/1973 | Martin | 340/825.34 |
| 4,274,089 | 6/1981 | Giles | 340/572 |
| 4,274,090 | 6/1981 | Cooper | 340/572 |
| 4,667,185 | 5/1987 | Nourse et al. | 340/572 |
| 4,975,681 | 12/1990 | Watkins et al | 340/572 |
| 5,218,189 | 6/1993 | Hutchinson | 340/572 |
| 5,495,229 | 2/1996 | Balch et al. | 340/551 |

FOREIGN PATENT DOCUMENTS

| | | | |
|---|---|---|---|
| 0602316 | 8/1993 | European Pat. Off. | G08B 13/24 |

*Primary Examiner*—Glen Swann

*Attorney, Agent, or Firm*—Robin, Blecker & Daley

[57] ABSTRACT

An electronic article surveillance system includes generating circuitry for generating an interrogation signal. The generating circuitry includes an interrogation coil for radiating the interrogation signal in an interrogation zone. A marker is secured to an article appointed for passage through the interrogation zone, and includes an active element for generating a marker signal including harmonic signal components at harmonics of an operating frequency of the generating circuitry. Detecting circuitry detects the harmonic signal components of the marker signal generated by the active element. The generating circuitry generates the interrogation signal in the form of discrete pulses and the detecting circuitry is operated concurrently with the generating circuitry.

28 Claims, 7 Drawing Sheets

PULSED INTERROGATION SIGNAL IN HARMONIC EAS SYSTEM

This application is a continuation of application Ser. No. 08/625,647, filed Mar. 29, 1996 (abandoned).

FIELD OF THE INVENTION

This invention relates to electronic article surveillance (EAS) systems and, in particular, to such systems in which EAS markers are detected on the basis of harmonic perturbations of an interrogation signal.

BACKGROUND OF THE INVENTION

It is well known to provide electronic article surveillance systems to prevent or deter theft of merchandise from retail establishments. In a typical system, markers designed to interact with an electromagnetic field placed at the store exit are secured to articles of merchandise. If a marker is brought into the field or "interrogation zone", the presence of the marker is detected and an alarm is generated. Some markers of this type are intended to be removed at the checkout counter upon payment for the merchandise. Other types of markers are deactivated upon checkout by a deactivation device which changes an electromagnetic characteristic of the marker so that the marker will no longer be detectable at the interrogation zone.

One type of magnetic EAS system is referred to as a "harmonic" system because it is based on the principle that a magnetic material passing through an electromagnetic field having a selected frequency disturbs the field and produces harmonic perturbations of the selected frequency. The detection portion of the system is tuned to recognize certain harmonic frequencies, and, if such frequencies are present, an alarm is actuated. Examples of harmonic EAS systems are disclosed in, e.g., U.S. Pat. Nos. 5,387,900 and 4,859,991. The assignee of the present application currently markets EAS systems of the harmonic type under the trademark "AISLEKEEPER".

Although harmonic EAS systems have been successfully deployed and operated, improvement in the performance of such systems remains desirable. In particular, in such systems there is an inevitable trade-off between reliability in detecting active markers in the interrogation zone and susceptibility to false alarms. Significant effort has been devoted to improving the ratio of reliability in detection to false-alarm susceptibility.

Another factor that must be taken into consideration is how strong an interrogation signal field may permissibly be generated. The latter factor has become increasingly important as regulatory authorities have proposed reductions in the strength of the signals transmitted by EAS systems. Much of the research effort has been directed to new developments in filtering or other signal processing techniques to be applied to the signal received in the EAS system, so that reliability can be enhanced or maintained in the face of reduced interrogation signal levels, and without increasing false alarms.

Examples of some difficulties encountered in reliable detection of harmonic EAS markers will now be discussed with reference to FIG. 1.

A conventional interrogation signal used in harmonic EAS systems, in the form of a continuous low-frequency sinusoidal signal, is shown as trace 10 in FIG. 1(*a*). A typical frequency for the interrogation signal is 73.125 Hz. When a marker is present in the interrogation zone, and the level of the interrogation signal at the point in the field where the marker is located reaches a certain positive or negative amplitude level, an active element in the marker is caused to "switch", i.e., to change its magnetic polarity. These points in the interrogation signal cycle are indicated by the vertical dotted lines in FIG. 1(*a*). When the marker switches, it causes a relatively sharp perturbation or "spike" in the field formed by the interrogation signal. These spikes (indicated by reference numeral 12 in FIG. 1(*a*)) are rich in harmonics of the interrogation signal frequency, and can be detected by suitably tuned receiving equipment.

Some of the difficulties encountered in harmonic EAS systems result from variations in the effective interrogation signal level from location to location within the interrogation zone. For example, in a typical system installation in which interrogation signal transmitting antennas are provided on opposite sides of a store exit, the interrogation signal field is strongest in locations that are close to one of the transmitting antennas, and is weakest at a central location that is substantially equidistant from the antennas.

Trace 14 in FIG. 1(*b*) is indicative of the effective interrogation signal level at a point in the interrogation zone where the signal is lower in amplitude than the signal shown in FIG. 1. As indicated by the vertical dotted lines in FIG. 1(*b*), a marker exposed to the signal represented by trace 14 will switch at a point in the signal cycle that is closer to the peak of the cycle than was the case for a marker exposed to the higher-amplitude signal of FIG. 1(*a*). In comparing the marker switching points in FIG. 1(*b*) to those of FIG. 1(*a*), it will be observed that in FIG. 1(*b*) the gradient of the interrogation signal is lower at the switching points than in FIG. 1(*a*). As a result, the marker switches more slowly, and produces a marker signal (indicated by spikes 16) that is lower in amplitude than the spikes 12 of FIG. 1(*a*). The relatively low-amplitude spikes 16 of FIG. 1(*b*) are more difficult to detect than the higher-amplitude and sharper spikes 12 of FIG. 1(*a*).

Another difficulty which results from the variation in field strength within the interrogation zone (and as also illustrated in FIGS. 1(*a*) and 1(*b*)) is variation in the timing of the marker signal from cycle to cycle of the interrogation signal, as the marker is carried between locations of varying field strength. Because of this variation or "jitter" in the timing of the marker signal relative to the interrogation signal, it can be difficult for the receiving equipment to distinguish between the marker signal and random noise impulses. Also, it becomes necessary to operate the detection equipment either continuously or throughout large portions of the interrogation signal cycle. This increases the likelihood that the detection equipment will generate false alarms in response to noise.

It could be contemplated to increase the amplitude of the interrogation signal in order to move the marker switching point further away from the peak of the interrogation signal cycle, thereby increasing the amplitude of the marker signal even when the marker is at a relatively low-strength portion of the interrogation field. It will be understood that the increased field strength itself, and also the larger gradient of the interrogation signal at the switching point, would both contribute to increase the amplitude of the marker signal. However, the above-mentioned regulatory constraints place limits on the amplitude of the radiated interrogation signal.

Another possible solution would be simply to reduce the width of the interrogation zone (i.e., by moving the transmit antennas closer together), so that the signal at the point of minimum strength would be of higher amplitude, but this cannot be done without reducing the width of the store exit, which would cause inconvenience for store patrons and would not be acceptable to retailers, who are the customers for EAS systems.

It could also be contemplated to increase the frequency of the interrogation signal (without increasing the amplitude), which would provide a higher gradient of the interrogation signal at the marker switching point, thereby increasing the amplitude and sharpness of the marker signal. But applicable regulations again come into consideration, because at higher frequencies the maximum permissible field strength is lower. This would make it necessary to reduce the signal amplitude if the frequency were increased, so that the width of the interrogation zone would have to be reduced. As noted above, this would not be acceptable to customers for the system.

OBJECTS AND SUMMARY OF THE INVENTION

It is accordingly an object of the invention to provide a harmonic EAS system in which markers can be detected more reliably.

It is a further object of the invention to provide a harmonic EAS system with reduced susceptibility to false alarms.

It is another object of the invention to produce a harmonic EAS system in which higher-amplitude marker signals are generated.

It is still another object of the invention to provide a harmonic EAS system in which the timing at which marker signals are generated, relative to an interrogation field signal, can be predicted with greater precision than in existing systems.

It is yet a further object of the invention to provide a harmonic EAS system that is less subject to disruption by ambient interference signals than existing systems.

Still a further object is to maintain or improve system performance while reducing the strength of the interrogation field signal.

According to a first aspect of the invention, there is provided an electronic article surveillance system including generating circuitry for generating an interrogation signal, the generating circuitry including an interrogation coil for radiating the interrogation signal in an interrogation zone, a marker secured to an article appointed for passage through the interrogation zone, the marker including an active element for generating a marker signal including harmonic signal components at harmonics of an operating frequency of the generating circuitry, and detecting circuitry for detecting the harmonic signal components of the marker signal generated by the active element, wherein the generating circuitry generates the interrogation signal in the form of discrete pulses.

Further in accordance with this aspect of the invention, the detecting circuitry operates to detect the marker signal generated by the active element concurrently with times during which the discrete pulses are generated by the generating circuitry. Moreover, the detecting circuitry may be arranged so that it does not operate to detect the marker signal at times that do not correspond to the discrete pulses. The discrete pulses may be such that each one has a pulse length that defines the operating frequency of the generating means, with all the pulses being equal in pulse length. The pulse length may have a duration that is within a preferred range from at least about 2 milliseconds to no more than about 20 milliseconds. Furthermore, the generating circuitry may operate to provide between each pair of successive pulses a time gap that has a duration at least as long as, and possibly five times as long as, the pulse length of the pulses. Each pulse may be formed so that it is one cycle of a sinusoidal signal or a triangular wave. Also, the discrete pulses of the interrogation signal may be generated according to a binary code pattern so that a cycle of the interrogation signal is generated in each time period corresponding to a "1" value of the binary code pattern, and a pause in the interrogation signal is formed in each time period corresponding to a "0" value of the binary code pattern.

Still further, the EAS system provided in accordance with this aspect of the invention may include circuitry for determining a level of the detected marker signal, and the generating circuitry may selectively vary a level of the pulses of the interrogation signal according to the determined level of the detected marker signal. For example, the generating circuitry may be operated to reduce the level of the pulses of the interrogation signal when the level of the detected marker signal exceeds a predetermined threshold value.

Still further in accordance with this aspect of the invention, the system may include interference detecting circuitry for detecting a periodically recurring noise signal present in the interrogation zone, and the generating circuitry may be operated to adjust a timing at which the pulses of the interrogation signal are generated so that the pulses do not coincide with the periodically recurring noise signal. The periodically recurring noise signal may have a timing that corresponds to the power line operating frequency.

According to another aspect of the invention, there is provided a method of operating a harmonic EAS system, including the step of generating a harmonic EAS system interrogation signal in the form of discrete pulses. Further in accordance with this aspect of the invention, the method may include detecting EAS marker signals concurrently with the discrete pulses of the interrogation signal, and refraining from detecting marker signals at times that do not correspond to the discrete pulses.

By operating the transmitting circuitry of a harmonic EAS system in a pulsed or intermittent manner, the effective frequency, and thus the gradient of the interrogation signal at the marker switching point, can be increased, without exceeding regulatory limits on the average radiated power of the transmitting circuitry. A marker signal that is higher in amplitude, and therefore more easily detected, can thereby be produced.

Furthermore, the pulsed generation of the interrogation signal makes it possible to limit the time windows during which tag signal detection operations must be performed, thereby reducing the possibility that the system will generate a false alarm in response to impulsive noise. Moreover, "jitter" in the timing of the marker signal can be reduced, thereby making it easier to distinguish between the marker signal and ambient noise.

In addition, with the pulsed interrogation signal it becomes possible to shift the timing of the interrogation signal pulses relative to predictable noise (such as may be generated in relation to the power line signal) so that the timing of the marker signal is moved to a relatively low-noise time interval. Further, the amplitude of the pulses can be reduced when a high-amplitude "marker-like" signal is generated, to aid in distinguishing between actual markers and other objects (such as shopping carts) that mimic EAS markers.

Still further, use of a pulsed interrogation signal makes it possible to operate the system at an over-all lower average power level, which permits the cost of the system to be reduced by decreasing the size of heat-sink structures on which transmitter power circuitry is mounted.

The foregoing and other objects, features and advantages of the invention will be further understood from the following detailed description of preferred embodiments and practices thereof and from the drawings, wherein like reference numerals identify like components and parts throughout.

DESCRIPTION OF PREFERRED EMBODIMENTS AND PRACTICES

Embodiments of the invention will now be described, initially with reference to FIG. 2.

Figure 2:
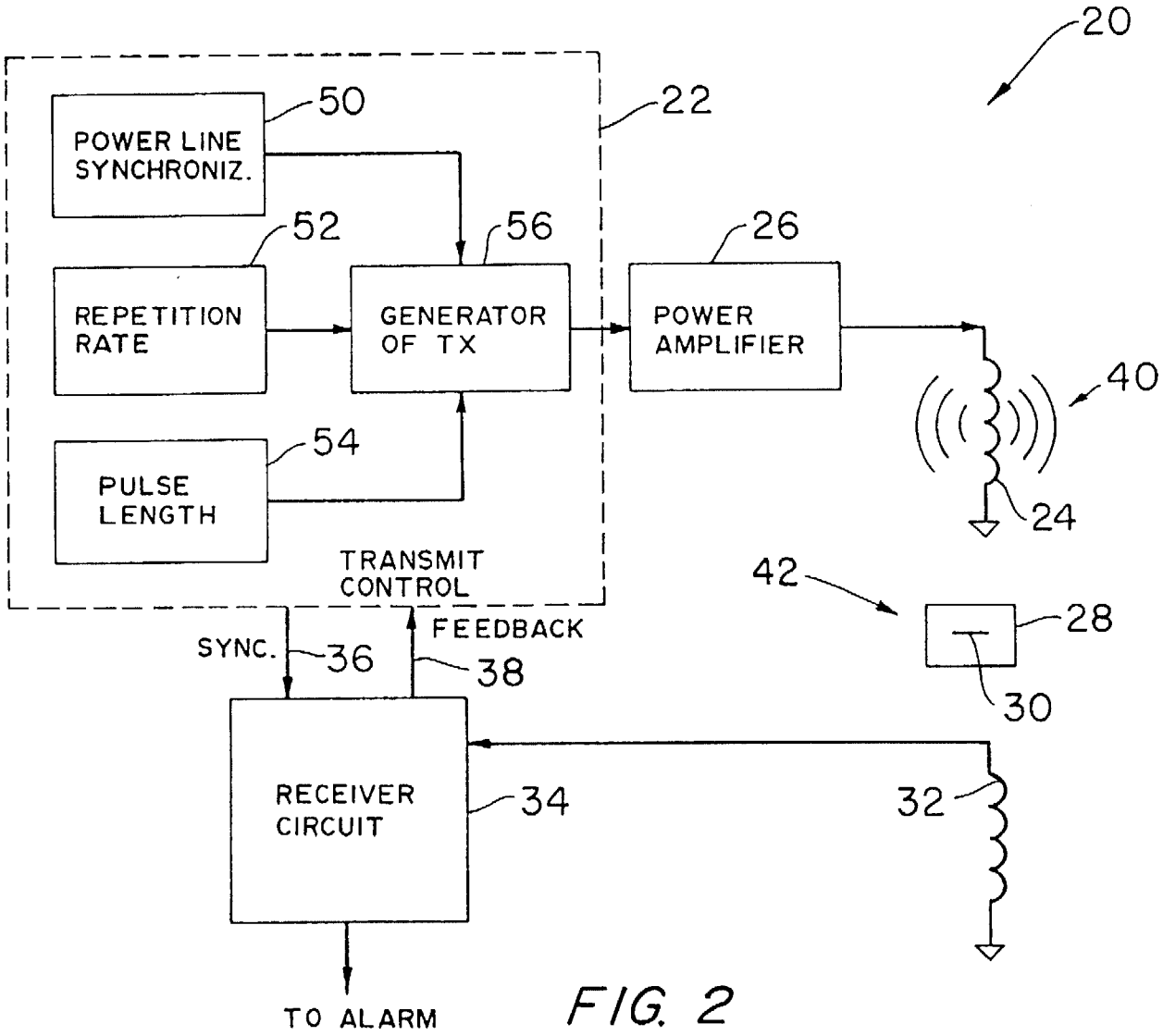
FIG. 2 is a block diagram of an EAS system provided in accordance with an embodiment the present invention.

In FIG. 2, reference numeral 20 generally indicates a harmonic EAS system provided in accordance with the invention. The system 20 includes a transmit control circuit 22, a transmit antenna 24, a power amplifier 26 connected between the transmit control circuit 22 and the antenna 24, a marker 28 including an active element 30, a receive antenna 32, and a receiver circuit 34 connected to the receive antenna 32. Signal paths 36 and 38 are provided between the transmit control circuit 22 and the receiver circuit 34.

The transmit control circuit 22 generates an interrogation signal waveform that is amplified by power amp 26 to form an antenna drive signal. The antenna drive signal is applied to energize the transmit antenna 24, which radiates a corresponding interrogation signal, as indicated at 40, into an interrogation zone 42.

The marker 28 is present in the interrogation zone 42 and is exposed to the interrogation signal 40. The active element 30 of the marker 28 responds to the interrogation signal 40, by changing or "switching" magnetic polarity, thereby causing perturbations in the magnetic field formed by the interrogation signal. The perturbations are picked up at receive antenna 32 and fed to the receiver circuit 34. The receiver circuit 34 analyzes the signal received at the antenna 32, detects the perturbations caused by the active element 30, determines that the marker 28 is present in the interrogation zone, and actuates an alarm.

Figure 3:
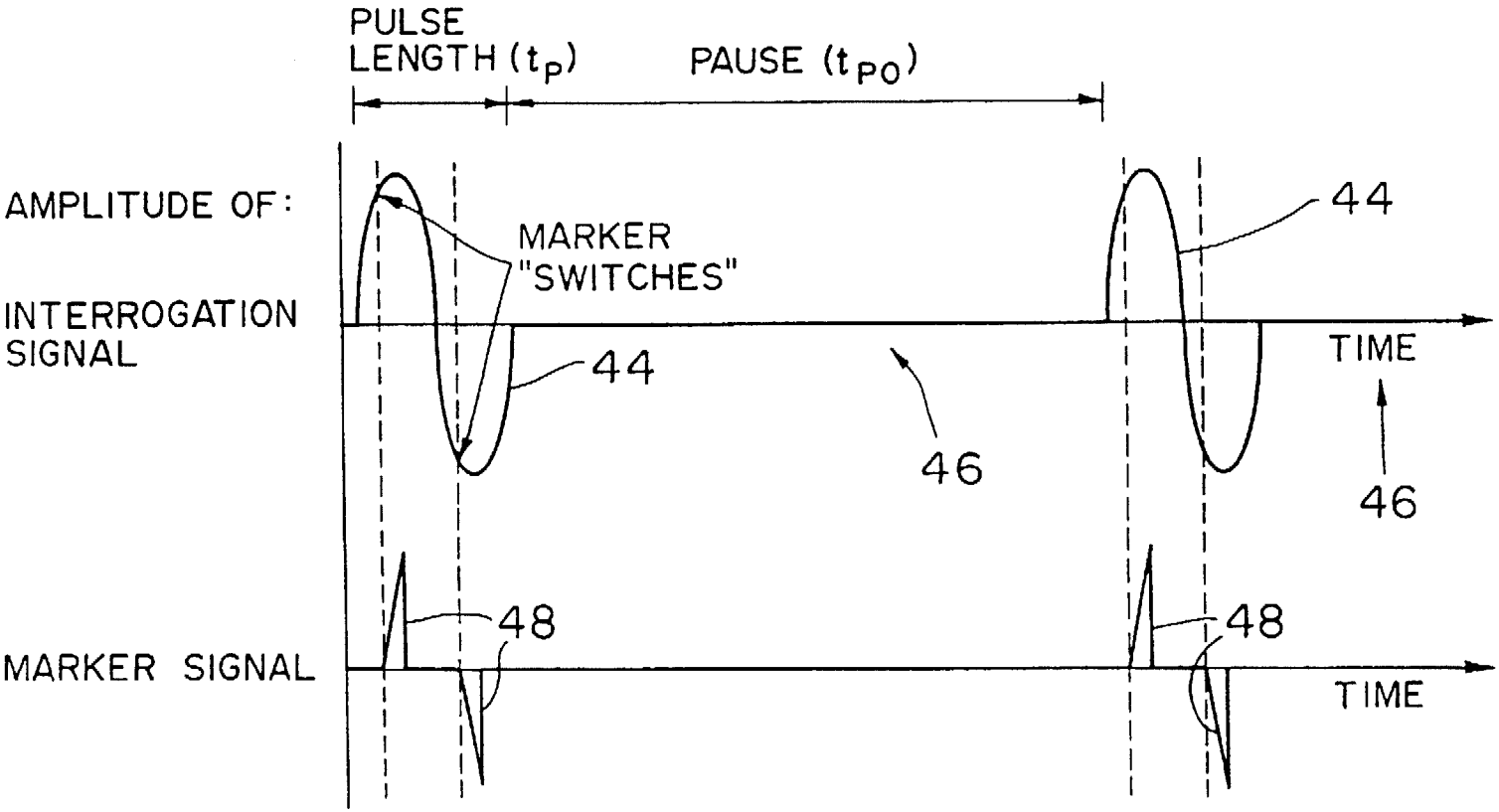
FIG. 3 is a waveform illustration of a pulsed interrogation signal and a corresponding marker signal generated by the system of FIG. 2.

FIG. 3 illustrates the interrogation signal generated in the system of FIG. 2, as well as the resulting marker signal. As seen from FIG. 3, the interrogation signal is made up of isolated pulses 44, each of which is separated from its respective preceding and succeeding pulses by a pause or time gap 46.

According to the embodiment of the invention illustrated in FIG. 3, each of the pulses is a single cycle of a sinusoidal signal, having a pulse length $t_P$ which defines a nominal frequency f ($=1/t_P$) of the signal pulses. Each time gap has a duration of $t_{PO}$ which defines a repetition rate r ($=1/(t_P+t_{PO})$) at which the pulses are produced.

When a marker 30 is present in the interrogation zone, marker signals 48 are generated at switching points indicated by the vertical dotted lines in FIG. 3. The receiver circuit 34 need not be, and preferably is not, operated during the time gaps between pulses, but is operable during periods in which the pulses are being produced. The transmit control circuit 22 accordingly provides a synchronizing signal to the receiver circuit 34 via the signal path 36, so that the timing of operation of the receiver circuit 34 is synchronous with operation of the transmitter portion of the system.

Referring again to FIG. 2, blocks 50, 52, 54 and 56 represent functions carried out in the transmit control circuit 22. The pulse length $t_P$ and the repetition rate r (corresponding to the inverse of ($t_P+t_{PO}$)) are respectively determined at blocks 54 and 52. The power line synchronizing block 50 is connected to the AC power supply line (not shown) and provides phase synchronization of the pulse 44 (FIG. 3) with the power line signal. The transmit signal generating block 56 produces the interrogation signal waveform shown in FIG. 3 on the basis of the outputs of the blocks 50–54. The resulting waveform is then provided to the power amplifier 26 for generation of the desired antenna drive signal.

It is to be understood that most or all of the functions illustrated by blocks 50–56 may be carried out using conventional digital circuitry, such as a suitably programmed microcontroller or microprocessor, coupled to the power amplifier 26 through digital-to-analog conversion circuitry (not separately shown).

The antennas 24 and 32 may be the same as those used in conventional harmonic EAS systems, although the transmitter circuitry provided in accordance with the invention to drive the antenna 24 is arranged so as not to form a resonant circuit with the antenna 24. It is contemplated to provide two or more transmit antennas and two or more receive antennas. Some or all of the antennas may be used both for transmitting and receiving.

Figure 1B:
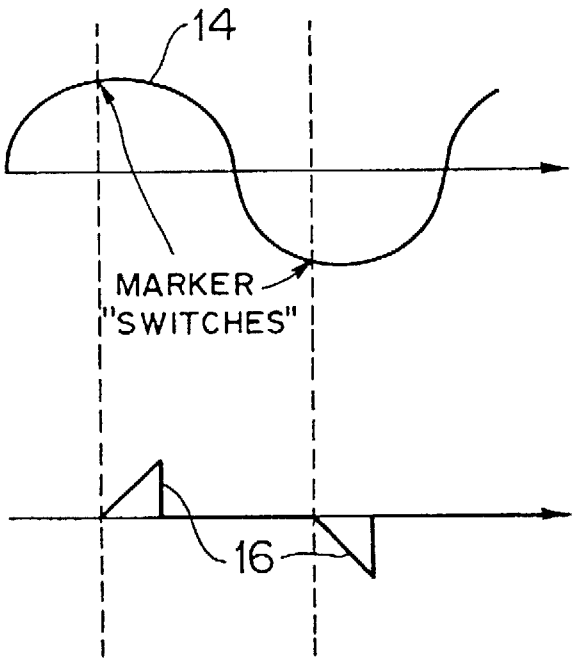
FIG. 1(b) (PRIOR ART)
FIGS. 1(*a*) and 1(*b*) are illustrations of interrogation signal and marker signal waveforms generated in conventional harmonic EAS systems.
Figure 1A:
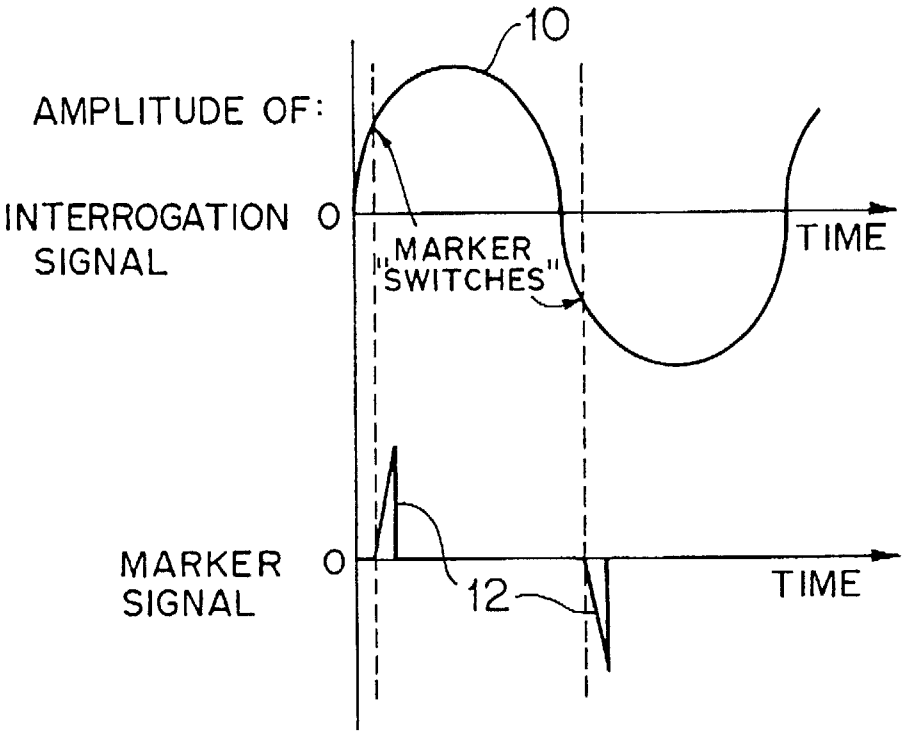
FIG. 1(a) (PRIOR ART)
Figure 4:
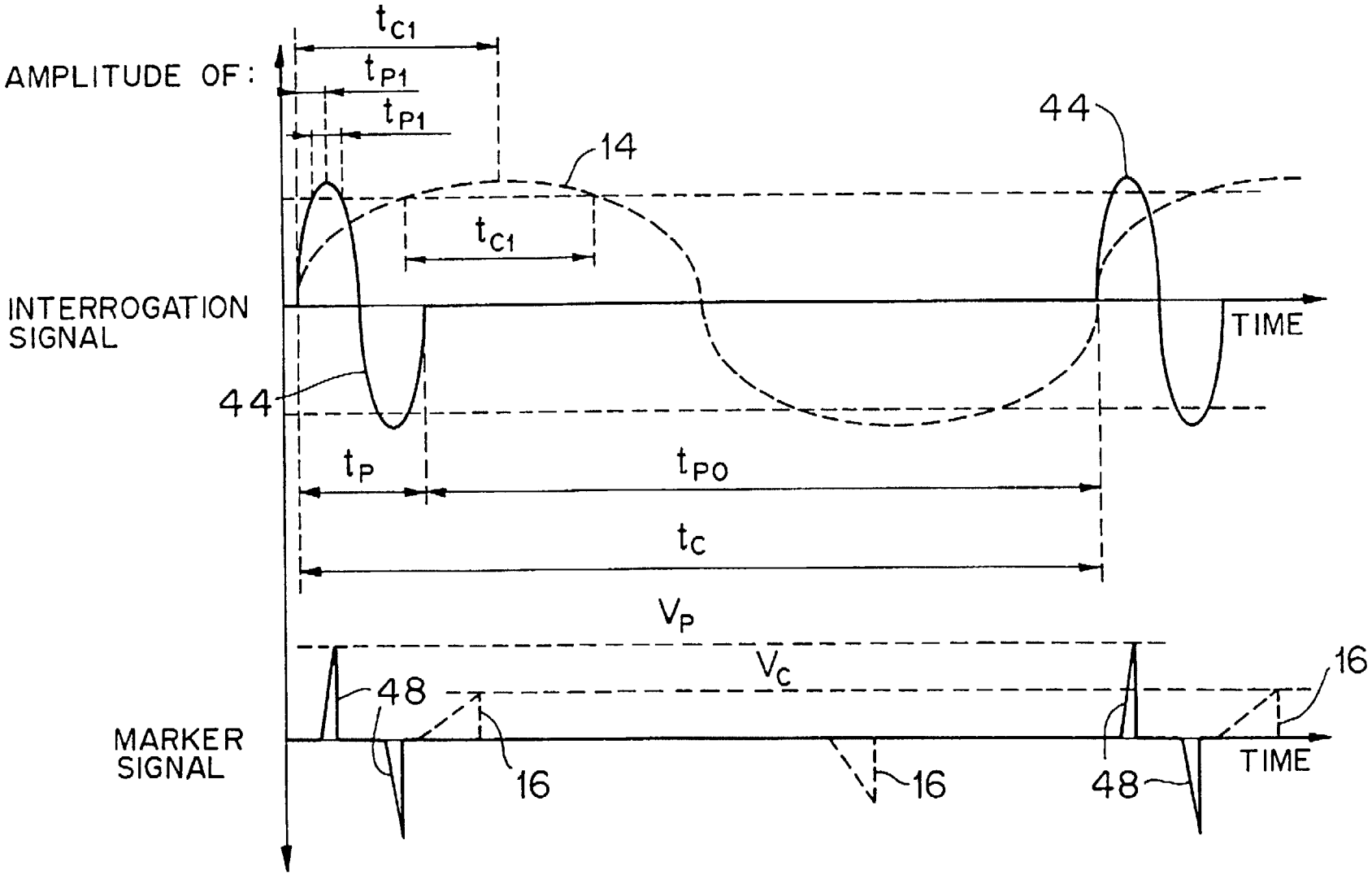
FIG. 4 illustrates, by way of comparison, interrogation and marker signals respectively generated in accordance with the invention and in accordance with the prior art.

In FIG. 4, the interrogation signal and marker signal waveforms produced in accordance with the invention as shown in FIG. 3, and the prior art interrogation signal and marker waveforms of FIG. 1(*b*), are presented together in combination, for ease of comparison.

In addition to features previously described in connection with FIGS. 1(*b*) and 3, FIG. 4 also shows a time interval $t_{C1}$ which represents a time interval from the zero crossing to the signal peak of the prior art interrogation signal 14, during which period the marker signal 16 may be produced, and a corresponding time interval $t_{P1}$ for the interrogation pulse 44, which is the time period within which a marker signal 48 may be produced in accordance with the invention. If desired, in the system provided in accordance with the invention, the receiver circuit 34 may be operated only during time windows of length $t_{P1}$ corresponding to the "up slopes" of positive peaks and the "down slopes" of negative peaks of the pulses 44. By contrast, in prior art systems using the continuous interrogation signal waveform 14, the receiver circuit, if not operated continuously, must be operated at least during windows of length $t_{C1}$ corresponding to the positive- and negative-going segments of the interrogation signal 14. It will be observed that the time period during which the inventive receiver circuit must be operated is much shorter than is required according to the prior art. The shorter receiver operating window made possible by the present invention significantly reduces the system's susceptibility to noise.

The time intervals indicated by the symbols $t_{CJ}$ and $t_{PJ}$ respectively correspond to periods during which the continuous and pulsed interrogation signals are at or above the amplitude required to "switch" the marker.

It will be observed that in FIG. 4 the conventional continuous-wave interrogation signal 14 and the pulses 44 are indicated as having substantially the same amplitude. However, the pulses 44, with their high nominal frequency, provide a larger signal gradient at the marker switching point than the conventional interrogation signal, resulting in marker signals 48 having an amplitude $V_P$ that is substantially higher than the amplitude $V_C$ of the prior art marker signals 16. The marker signals 48 are therefore much more readily detectable than the prior art signals 16.

Further, as will be appreciated from the previous comparison of the interval $t_{CJ}$ with the interval $t_{PJ}$, the marker signals 48 are much less subject to jitter as compared to the marker signals 16, which improves the ability of the inventive EAS system to detect the marker signals.

It is also indicated in FIG. 4 that the repetition rate of the pulsed interrogation signal provided in accordance with the invention corresponds to the frequency of the conventional continuous interrogation signal (i.e., the period $t_C$ of the continuous signal is equal to the sum of the pulse length $t_P$ and the duration of the time gap $t_{PO}$). If it is assumed that the conventional continuous signal is at the typical frequency of 73.125 Hz, then the repetition rate r of the pulsed interrogation signal in the example shown would also be 73.125 Hz. The nominal frequency of each pulse may be, for example, in the range of 400–500 Hz, producing a time gap duration $t_{PO}$ that is on the order of five times as long as the pulse length $t_P$. It will be recognized that a nominal signal frequency f of about 400–500 Hz corresponds to a pulse length of about 2.0–2.5 milliseconds.

Other combinations of pulse-length and repetition rate are also contemplated. For example, a nominal frequency f as low as 50 Hz (i.e., pulse length as long as 20 milliseconds) and a repetition rate r as low as 25 Hz are also contemplated. Furthermore, for the contemplated range 50–500 Hz of the nominal frequency f, a ratio of time gap duration to pulse length ($t_{PO}/t_P$) as low as 1:1 is contemplated. A repetition rate r of 250 Hz or even higher is also contemplated by the invention. A preferred range for the repetition rate r is about 50 to 100 Hz.

Figure 5:
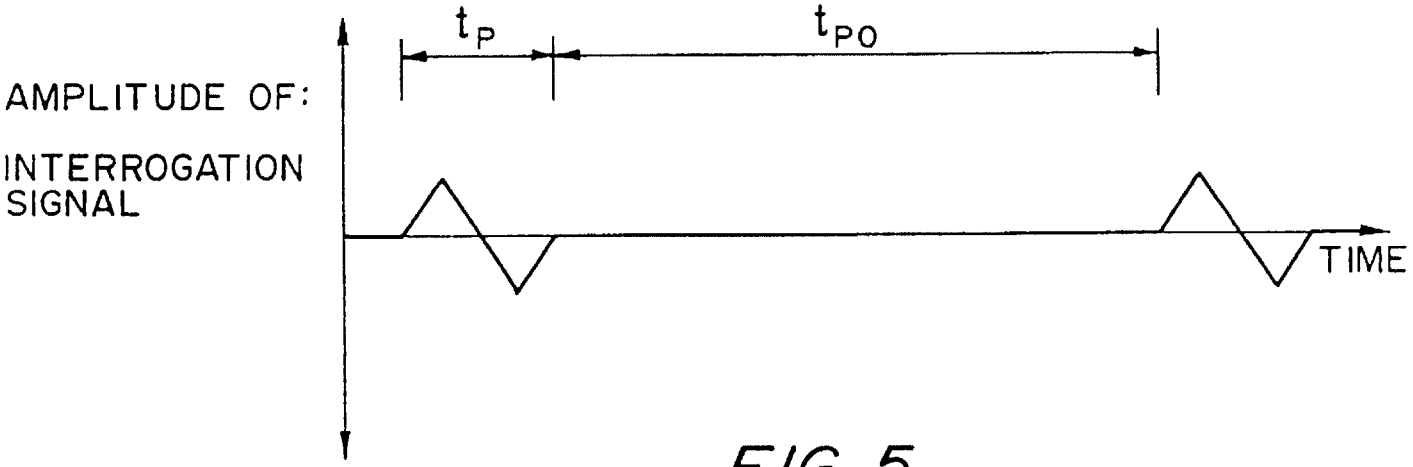
FIG. 5 illustrates a triangular-wave pulsed interrogation signal generated according to an alternative embodiment of the invention.

It is also contemplated to provide pulses that are shaped differently from the sinusoidal pulses shown in FIGS. 3 and 4. For example, the transmit control circuit 22 of FIG. 2 could be arranged (e.g., by suitable programming of a microcontroller, which is not separately shown) to produce triangular wave pulses, as shown in FIG. 5. This waveform has the advantage of providing a fixed gradient, up to the peak of the signal, so that the gradient at the marker switching point can be known in advance. Other pulse shapes may also be used, although it is desirable to avoid square waves or other pulse shapes (such as high-frequency sinusoids) that produce very high gradients. Although, in general, a steep gradient is desirable because the amplitude of the marker signal is enhanced, if the gradient is too steep then objects other than the marker 30 may, upon exposure to the interrogation signal, generate signals that cannot readily be distinguished from the marker signal. Such objects may include keys, key rings, coins or EAS markers intended for use with different systems.

As has already been noted, the pulsed-signal harmonic EAS system disclosed herein provides the advantages of enhanced marker signal, reduced signal jitter, limited receiver operating window and relative ease of compliance with regulatory restraints related to interrogation signal strength. Another beneficial feature that may be provided in a pulsed-signal EAS system is adjustment of the position of the interrogation signal pulses so as to avoid recurrent ambient noise signals. This feature will now be discussed with reference to FIG. 6.

Figure 6:
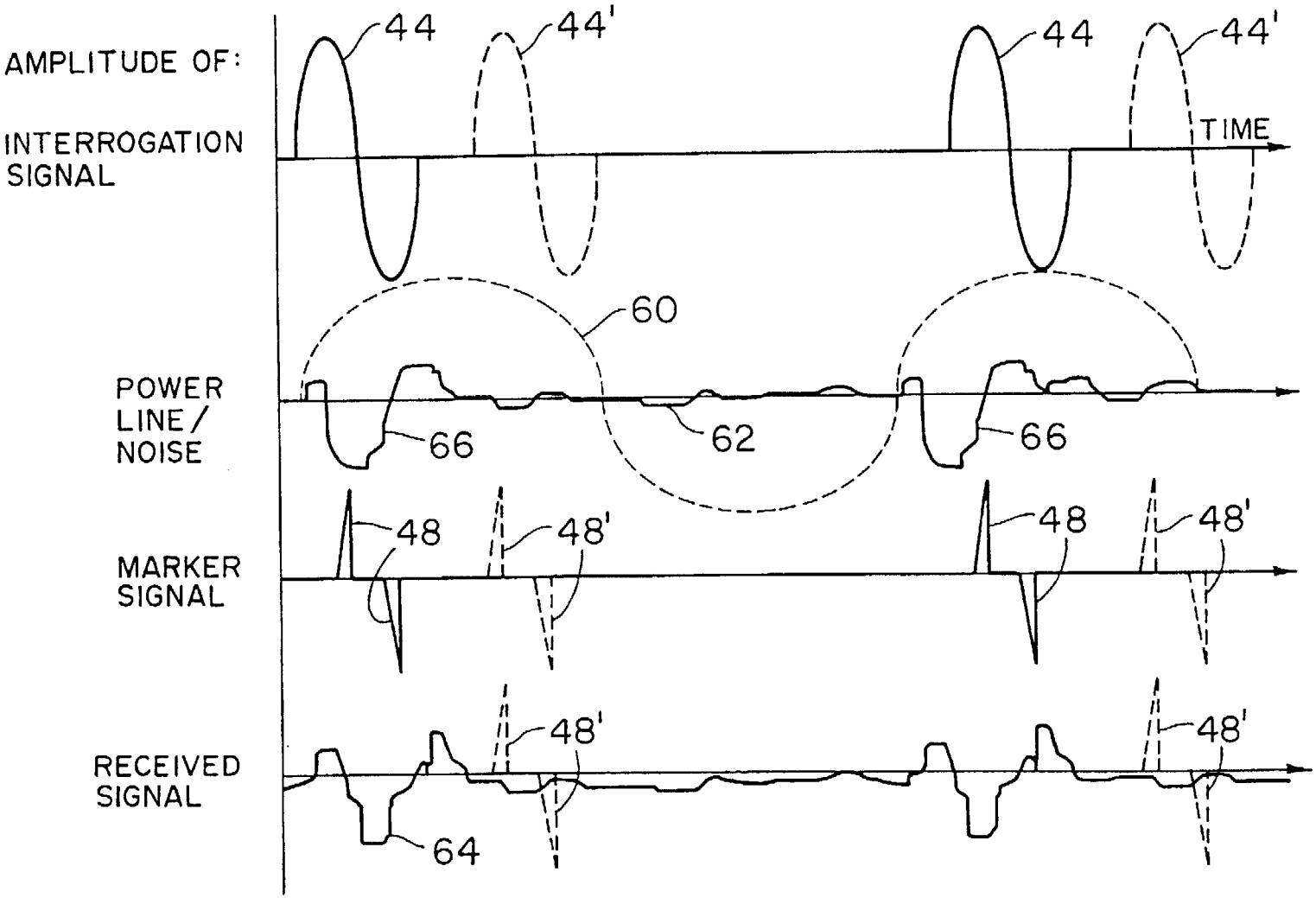
FIG. 6 illustrates adaptive timing of interrogation signal pulses, generated in accordance with a second alternative embodiment of the invention.

Shown at the first horizontal axis in FIG. 6 are interrogation signal pulses 44 and repositioned pulses 44', the latter being shown in phantom.

The waveforms shown at the second horizontal axis represent, respectively an AC power line signal (dotted line trace 60), and a noise signal (indicated by trace 62) with periodically recurring components 66 related to the power line signal.

At the third horizontal axis in FIG. 6 there are shown marker signals 48, as well as shifted marker signals 48' corresponding to the shifted interrogation signal pulses 44'.

At the last horizontal axis in FIG. 6, trace 64 is indicative of a signal, received at the receiver circuit 34 (FIG. 2), and corresponding to a sum of the noise signal 62 and the un-shifted marker signals 48. The shifted marker signals 48' are also shown in juxtaposition with the signal trace 64.

As will be well understood by those who are skilled in the art, the receiving circuitry of conventional harmonic EAS systems includes capabilities for storing, in the form of digital samples, several "frames" (i.e., transmit signal cycles) of the signal received at the receive antenna, as well as the capability of analyzing the stored digital signals. According to the aspect of the invention illustrated in FIG. 6, the receiver circuit 34 (FIG. 2) is programmed to analyze the stored signal frames in order to detect recurring noise patterns such as the relatively high amplitude and quasi-periodic noise bursts 66 shown as part of trace 62. It will be observed that the noise bursts 66 are correlated with the beginning of the positive-going phase of the power line signal 60. The noise bursts 66 occupy about 25% of the power line signal cycle.

If the marker signals 48 happen to coincide with the noise bursts 66, the resulting signal, as shown in trace 64, might not be recognized by the receiver circuit 34 as including a marker signal. However, if the transmit pulses are shifted, as shown at 44', so as not to coincide with the noisy part of the power line signal cycle, then the resulting shifted markers signals 48' can be readily detected in the "quiet" intervals between the recurrent noise bursts.

According to a preferred embodiment of the invention, the receiver circuit 34 is operated to detect periodically recurring noise, and upon detection of a recurrent noise signal, the receiver generates a feedback signal which is supplied to the transmit control circuit 22 via the signal path 38 (FIG. 2). In response to the feedback signal, the transmit control circuit 22 shifts the timing of the interrogation signal pulses to avoid the predicted occurrence of the noisy part of the power line signal cycle. Of course, the receiver circuit's "listening window" (i.e., the interval during which the receiver operates to detect marker signals) is also shifted to correspond to the adjusted interrogation pulse timing.

This may be done either in response to a signal provided by the transmit control circuit on signal path 36, or based on the anticipated response of the transmit control circuit to the feedback signal.

It will be noted that, for purposes of illustration, the repetition rate of the interrogation signal is shown in FIG. 6 as matching the power line signal frequency. However, in a preferred embodiment, the repetition rate is selected to be different from the power line frequency, and is altered in phase when required to prevent the interrogation signal pulse from coinciding with predicted noisy parts of the power line signal cycle. It should be understood that the pulse-shifting technique shown in FIG. 6 can also be applied to avoid recurrent noise that is not correlated with the power line signal.

Figure 7:
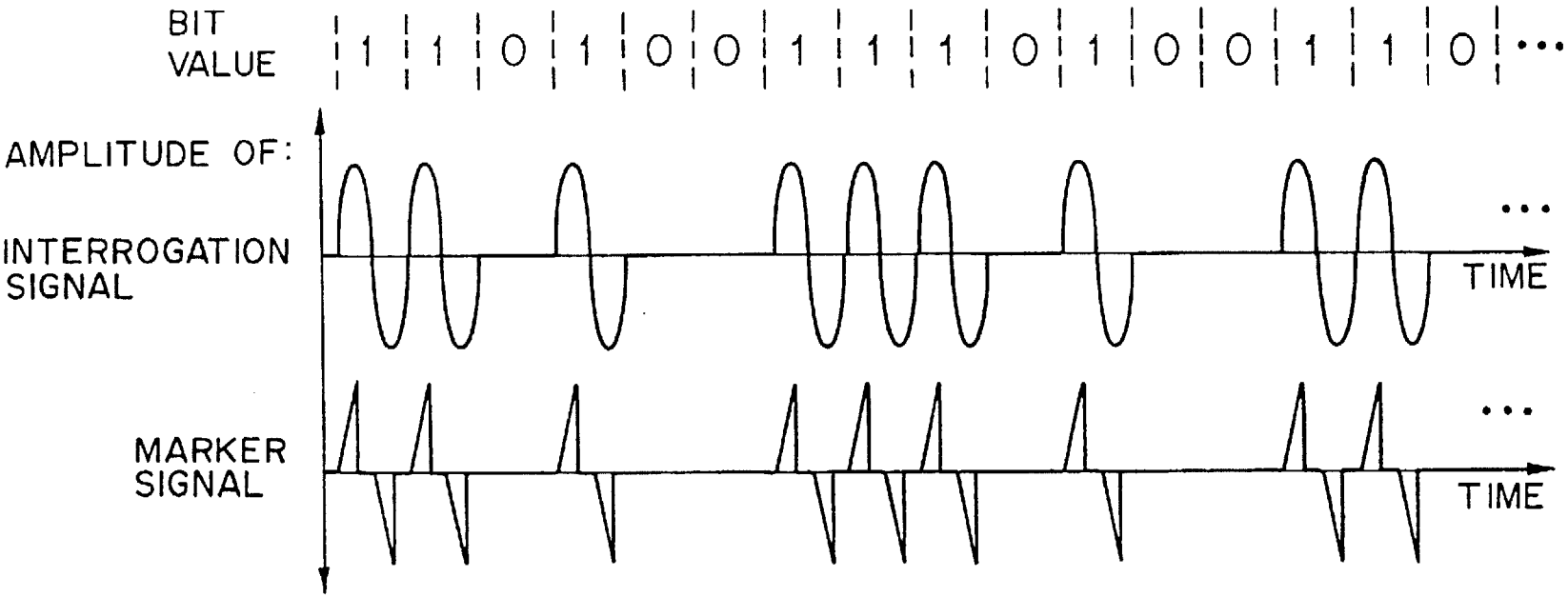
FIG. 7 illustrates a coded-pulse interrogation signal generated in accordance with a third alternative embodiment of the invention.

Still another advantageous technique that is made possible by use of a pulsed interrogation signal is illustrated in FIG. 7. In the example shown in FIG. 7, the pulses of the interrogation signal are generated in accordance with a predetermined digital code, so that marker signals corresponding to the code are produced. Such coded marker signals can readily be distinguished from noise or other forms of interference, thereby improving the ratio of the marker detection rate ("pick" rate) to the false alarm rate.

It will be noted from FIG. 7 that the pulses of the interrogation signal may consist of one or more than one signal cycle. Moreover, the intervals between pulses are subject to variation, although such intervals between cycles are constrained to be equal in duration with, or an integral multiple of, the pulse length. In the example shown in FIG. 7, the coding is performed by time interval, with each time interval being assigned a value of "1" or "0". In the intervals having the value "1", one cycle of the interrogation signal is generated; in the "0" value intervals, a pause occurs. Where two or more consecutive "1" intervals occur, the signal pulse has a length that is the corresponding multiple of the interrogation signal cycle. Similarly, the length of each pause between signal pulses is determined by the number of consecutive "0" value intervals. It will be noted that the marker signals are generated in a pattern that corresponds both to the coded bit value and the interrogation signal. In the example shown in FIG. 7, it is assumed that the coded bit pattern is formed by continuously repeating the pattern "1101001110100".

Of course, the polarity of the coded interrogation signal could be reversed, so that signal pulses correspond to 0's and pauses correspond to 1's.

As an alternative to, or in addition to, producing the interrogation signal in accordance with a binary code, the amplitude of the interrogation signal pulses may be varied when the receiver circuitry detects a signal that is similar in shape to a marker signal, but has an amplitude in excess of a predetermined threshold level. Specifically, the amplitude of the interrogation signal pulses may be reduced in such case, making it possible to distinguish between signals that are in fact generated by a marker, and signals generated by objects such as shopping carts that may tend to generate signals that mimic marker signals in response to high-level interrogation signals.

Although the invention has, up to this point, been described in terms of application to harmonic EAS systems, it is also contemplated to employ a pulsed interrogation signal in other types of EAS systems in which continuous interrogation signals have conventionally been employed. In such cases, operation of the system receiver circuitry is carried out concurrently with at least a portion of the interrogation signal pulses, and preferably is inhibited during times when no interrogation signal pulse is being transmitted.

Various changes in the foregoing apparatus and modifications in the described practices may be introduced without departing from the invention. The particularly preferred methods and apparatus are thus intended in an illustrative and not limiting sense. The true spirit and scope of the invention is set forth in the following claims.

What is claimed is:

1. An electronic article surveillance system, comprising:

generating means for generating an interrogation signal that alternates at a predetermined operating frequency, said generating means including an interrogation coil for radiating the interrogation signal in an interrogation zone;

a marker secured to an article appointed for passage through said interrogation zone, said marker including a magnetic element for generating a marker signal in the form of perturbations of said interrogation signal field which include harmonic signal components at harmonics of said operating frequency of said generating means; and detecting means for detecting said harmonic signal components of said marker signal generated by said magnetic element;

wherein said generating means generates said interrogation signal in the form of discrete pulses, each of said discrete pulses consisting of one cycle of said interrogation signal.

2. An electronic article surveillance system according to claim 1, wherein said detecting means operates to detect said marker signal generated by said active element concurrently with times during which said discrete pulses are generated by said generating means.

3. An electronic article surveillance system according to claim 2, wherein said detecting means does not operate to detect said marker signal at times that do not correspond to said discrete pulses.

4. An electronic article surveillance system according to claim 1, wherein each of said discrete pulses has a pulse length that is at least about 2 milliseconds.

5. An electronic article surveillance system according to claim 4, wherein each of said discrete pulses has a pulse length that is no more than about 20 milliseconds.

6. An electronic article surveillance system according to claim 1, wherein said generating means operates to provide between each pair of successive pulses time gap that has a duration at least as long as said pulse length.

7. An electronic article surveillance system according to claim 6, wherein said time gap is at least five times as long as said pulse length.

8. An electronic article surveillance system according to claim 1, wherein each of said pulses is formed as one cycle of a sinusoidal signal.

9. An electronic article surveillance system according to claim 1, wherein each of said pulses is formed as one cycle of a triangular wave.

10. An electronic article surveillance system according to claim 1, further comprising means for determining a level of the detected marker signal; and wherein said generating means selectively varies a level of said pulses of said interrogation signal according to the determined level of said detected marker signal.

11. An electronic article surveillance system according to claim 10, wherein said generating means reduces the level of said pulses of said interrogation signal when the level of said detected marker signal exceeds a predetermined threshold value.

12. An electronic article surveillance system according to claim 1, further comprising interference detecting means for detecting a periodically recurring noise signal present in the interrogation zone, and wherein said generating means adjusts a timing at which said pulses of said interrogation signal are generated so that said pulses do not coincide with said periodically recurring noise signal.

13. An electronic article surveillance system according to claim 12, wherein said periodically recurring noise signal has a timing that corresponds to a power line operating frequency.

14. A method of operating a harmonic electronic article surveillance system, comprising the step of generating a harmonic EAS system interrogation signal in the form of discrete pulses, each of said discrete pulses consisting of one cycle of said interrogation signal.

15. A method according to claim 14, further comprising the step of detecting EAS marker signals concurrently with said discrete pulses of said interrogation signal.

16. A method according to claim 14, further comprising the step of refraining from detecting EAS marker signals at times that do not correspond to said discrete pulses.

17. A method according to claim 14, wherein each of said discrete pulses has a pulse length that is at least about 2 milliseconds.

18. A method according to claim 17, wherein each of said discrete pulses has a pulse length that is no more than about 20 milliseconds.

19. A method according to claim 14, wherein a time gap is provided between each pair of successive pulses, said time gap having a duration at least as long as said pulse length.

20. A method according to claim 19, wherein said time gap has a duration at least five times as long as said pulse length.

21. A method according to claim 14, wherein each of said pulses is formed as one cycle of a sinusoidal signal.

22. A method according to claim 14, wherein each of said pulses is formed as one cycle of a triangular wave.

23. A method according to claim 14, further comprising the steps of detecting an EAS marker signal and determining a level of the detected EAS marker signal, and wherein said generating step includes reducing a level of said discrete pulses when the determined level of said detected marker signal exceeds a predetermined threshold.

24. A method according to claim 14, further comprising the step of detecting a periodically recurring noise signal present in an interrogation zone of said harmonic electronic article surveillance system, and wherein said generating step includes adjusting a timing at which said discrete pulses are generated so that said pulses do not coincide with said periodically recurring noise signal.

25. An electronic article surveillance system, comprising:

generating means for generating an interrogation signal that alternates at a predetermined operating frequency, said generating means including an interrogation coil for radiating the interrogation signal in an interrogation zone;

a marker secured to an article appointed for passage through said interrogation zone, said marker including a magnetic element for generating a marker signal in the form of perturbations of said interrogation signal field which include harmonic signal components at harmonics of said operating frequency of said generating means; and detecting means for detecting said harmonic signal components of said marker signal generated by said magnetic element;

wherein said generating means generates said interrogation signal in the form of discrete pulses according to a binary code pattern.

26. An electronic article surveillance system according to claim 25, wherein a cycle of said interrogation signal is generated in each time period corresponding to a "1" value of said binary code pattern, and a pause in said interrogation signal is formed in each time period corresponding to a "0" value of said binary code pattern.

27. A method of operating a harmonic electronic article surveillance system, comprising the step of generating a harmonic EAS system interrogation signal in the form of discrete pulses; said discrete pulses being generated according to a binary code pattern.

28. A method according to claim 27, wherein a cycle of said interrogation signal is generated in each time period corresponding to a "1" value of said binary code pattern, and a pause in said interrogation signal is formed in each time period corresponding to a "0" value of said binary code pattern.

* * * * *